United States Patent [19]

Hardy

[11] Patent Number: 4,916,842

[45] Date of Patent: Apr. 17, 1990

[54] PROTECTIVE DEVICE FOR THE TRIGGER GUARD OF A GUN

[76] Inventor: Mark L. Hardy, 124 Hwy. 75 N., Huntsville, Tex. 77340

[21] Appl. No.: 385,828

[22] Filed: Jul. 27, 1989

[51] Int. Cl.[4] ..... F41C 27/10

[52] U.S. Cl. ..... 42/70.07

[58] Field of Search ..... 42/70.07

[56] References Cited

U.S. PATENT DOCUMENTS 3,022,596 2/1962 Cannon ..... 42/70.07

4,030,221 6/1977 Doobenen et al. ..... 42/70.07

*Primary Examiner*—Charles T. Jordan

*Attorney, Agent, or Firm*—Harrison & Egbert

[57] ABSTRACT

A protective device for the trigger guard of a gun comprising a first plate member, a second plate member, a first arm connected to the first plate member, a second arm connected to the second plate member, and a spring arranged between the first arm and the second arm for resisting at least twenty-five pounds of compressive force exerted on the first and second arms. The first and second plate members having a surface area greater than the area of the trigger guard. At least one pin is affixed to one of the first and second plate members so as to extend between the first and second plate members. Each of the first and second plate members has a horizontal slot and an intersecting vertical slot for selectively positioning a plurality of pins between the first and second plate members. The compression spring is a tensioned steel strut of arcuate form extending between the first arm and the second arm.

20 Claims, 2 Drawing Sheets

PROTECTIVE DEVICE FOR THE TRIGGER GUARD OF A GUN

TECHNICAL FIELD

The present invention generally relates to devices used to prevent inadvertent discharge of firearms. More particularly, the present invention relates to those devices that can be easily removed by adults.

BACKGROUND ART

Many millions of households have handguns for personal protection, and in most of these households the guns are loaded for instant use. These loaded guns present a major safety problem if there are children in the home or if there are likely to be child visitors. The natural curiosity of children leads them to explore the various dressers, drawers, night stands, and other places where loaded guns are frequently kept. The novelty of a real gun is often overwhelming, and children point these guns at each other or at other persons, frequently with tragic results.

Because of the hazards of children, many gun owners seek to immobilize the gun with locks of various types. These generally take the form of a covering for the trigger of the handgun. While such locks are effective, they reduce the protective potential of the various revolvers and automatics because they must be unlocked with a key. In the dark of night, the key must be located, and preferably it must be kept in a separate drawer or piece of furniture than the gun. The key must be fitted, in the dark into the lock and the lock must be removed before the gun is available for use. This cumbersome unlocking procedure has caused many people to forego the safety of a lock and risk the hazards of accidents with children.

In the past, various types of safety covers for trigger guard assemblies have been devised as a safety precaution for preventing the accidental discharge of "unloaded firearms". Most of these types of safety covers have included the provision of a cover assembly hingedly or at least swingably mounted to the firearm. Not only does a hingedly mounted trigger guard hinder a person when firing the firearm, but it also has a tendency to cause the person contemplating using the firearm to maintain the safety cover in an open position so that the trigger of the firearm may be readily accessible should he desire to discharge the firearm.

U.S. Pat. No. 4,030,221 discloses a type of device that has a housing which is fitted over the trigger guard of a gun. This housing engages the trigger guard so that it cannot be removed except by overcoming the strength of a spring. The housing effectively prevents access to the trigger and thereby prevents accidental firing of the gun. This device, however, is a relatively complicated apparatus to manufacture. There are various components for this device. As a result, the cost of manufacturing this product is quite high and, as a result, the cost to the consumer is also high.

U.S. Pat. No. 3,022,596, issued to C. H. Cannon on Feb. 27, 1962, describes a rubber trigger guard that has lugs on the inside area. These lugs help to grip the trigger and act as a flexible guard for the trigger area. In order to remove this safety device, it is necessary to squeeze the guard. Unfortunately, however, the configuration of this device can be removed by children. This device is also manufactured and sized for specific types of trigger guards and is not applicable to a wide variety of applications.

It is an object of the present invention to provide a protective device for the trigger guard of a gun that effectively prevents removal by children.

It is another object of the present invention to provide a protective device for trigger guards that is relatively inexpensive and easy to manufacture.

It is still another object of the present invention to provide a protective device for the trigger guard of a gun that is adaptable to a wide variety of gun sizes, types, and trigger guard shapes.

It is still a further object of the present invention to provide a protective device for a trigger guard that can be quickly and safely removed by adults in times of emergency.

These and other objects and advantages of the present invention will become apparent from a reading of the attached specification and appended claims.

SUMMARY OF THE INVENTION

The present invention is a protective device for the trigger guard of a gun. This protective device is particularly designed so as to prevent children from having the ability to access the trigger of the gun. The protective device of the present invention comprises a first plate member, a second plate member, a plurality of pins affixed to one of the first and second plate members, and a compression spring connected to the first and second plate members. The pins extend between these plate members so as to affix the protective device in proper position about the trigger guard of the gun. The compression spring allows the first and second plate members to separate from each other upon receiving a desired compressive force. The compression spring should have such a tension that such spring requires twenty-five pounds or more of compressive force so as to separate the plate members.

The plate members are movable between a position in parallel relation to each other to a position in which they are angularly separated. The first plate member has a horizontal channel extending therethrough for receiving at least one of the plurality of pins. The first plate member also has a vertical channel extending therethrough which intersects the horizontal channel. This vertical channel is also for the purpose of receiving at least one of the plurality of pins. Similarly, the second plate member has both a horizontal channel and a vertical channel aligned with and of the same configuration as those channels of the first plate. These horizontal and vertical channels of the second plate member also receive a plurality of pins. Each of the pins of the first and second plate members are in alignment with each other. When the plate members are positioned around the trigger guard of a gun, these pins align with the inner surfaces of the trigger guard so as to prevent movement of the protective device relative to the trigger guard. Another of the pin members is positioned so as to prevent movement of the trigger.

The plate members have a surface area greater than the area of the trigger guard of a gun. Since the surface area of these plate members is larger than the trigger guard of a gun, it becomes impossible for young children to access the trigger area of the gun. Each of the plurality of pins is threadedly connected to the channels of the first and second plate members.

The compression spring comprises a first arm that is connected to the first plate member, a second arm that is connected to the second plate member, and a spring that is positioned between the first arm and the second arm so as to resist movement of the first and second arms. The first and second arms of the protective device are angularly separated. Each of the first and second arms has one end in close proximity to the end of the other. The spring is a torsion steel strut of arcuate shape that extends between these first and second arms. This compression spring is resistive of the application of less than twenty-five pounds of compressive pressure.

The first plate member has an angled section that extends to one end of the first arm. The second member also has an angled section that extends to a corresponding end of the second arm. These angled sections are positioned so that, when the protective device is in its normal position, the plate members will be in parallel relation to each other.

DETAILED DESCRIPTION OF THE INVENTION

Figure 1:
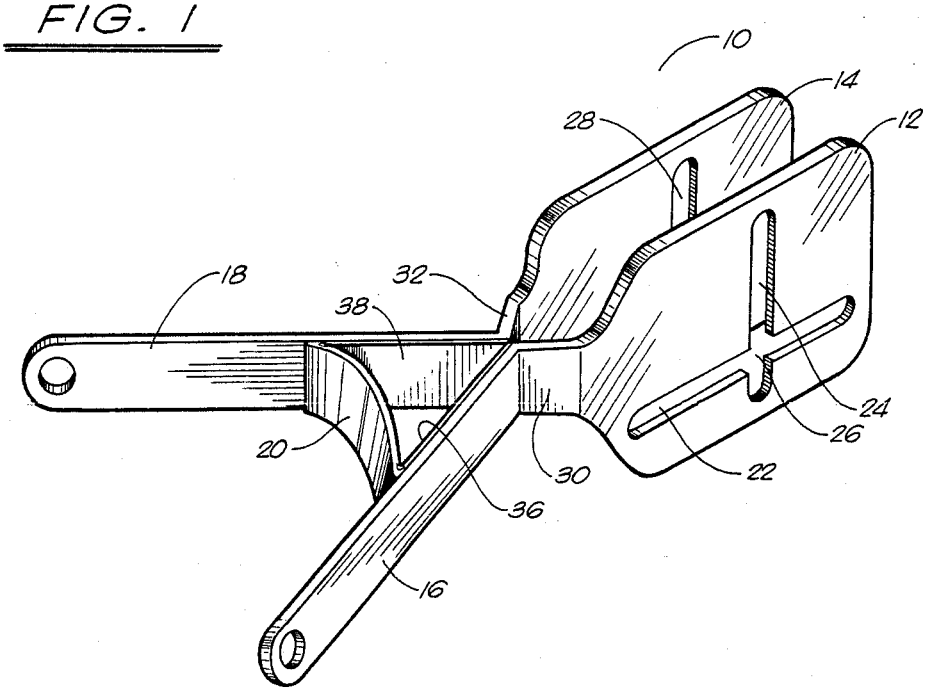
FIG. 1 is a perspective view of the protective device in accordance with the preferred embodiment of the present invention.

FIG. 1 shows at 10 the protective device in accordance with the preferred embodiment of the present invention. Protective device 10 is designed so as to fit around the trigger guard of a gun. Protective device 10 comprises a first plate member 12, a second plate member 14, a first arm 16, a second arm 18, and a spring 20.

The first plate member 12 and the second plate member 14 are in a position parallel to each other in the normal position of protective device 10. The first plate member 12 has a horizontal channel 22 that extends through the first plate member 12. The horizontal channel 22 is designed to receive a plurality of pins, to be described relative to FIG. 2. The first plate member 12 also includes a vertical channel 24 that extends through first plate member 12. Vertical channel 24 intersects at 26 with the horizontal channel 22. The vertical channel 24 receives pins in the same manner as such pins are received by the horizontal channel 22. The second plate member 14 also includes a horizontal channel (not shown) and a vertical channel 28. The horizontal and vertical channels of the second plate member 14 are aligned with the horizontal channel 22 and the vertical channel 24 of first plate member 12.

The first plate member 12 includes an angled section 30 that extends from one end of the first plate member 12 and connects with first arm 16. Similarly, the second plate member 14 also includes an angled section 32 that extends from one end of the second plate member 14 so as to connect with the second arm 18. Both the first plate member 12 and the second plate member 14 have a surface area greater than the area of a trigger guard of a gun. As such, the first plate member 12 and the second plate member 14 cover the entire area of this trigger guard so as to prevent small fingers from intruding into the trigger area. These plates members 12 and 14 should be made of a rigid material, such as plastic.

It is important that the spring 20 have a capacity to resist a compressive force of twenty-five pounds or less. After experimentation, it has been found that children of a certain age do not have the strength to compress arms 16 and 18 so as to angularly separate plates 12 and 14 from about the trigger guard of a gun. Spring 20 is positioned between the first arm 16 and the second arm 18. Spring 20 includes surface portions 36 and 38 that are in surface-to-surface contact with a portion of the inner side of arms 16 and 18, respectively. Spring 20 comprises a torsioned steel strut of arcuate shape that extends between the inner surfaces of arms 16 and 18.

Figure 2:
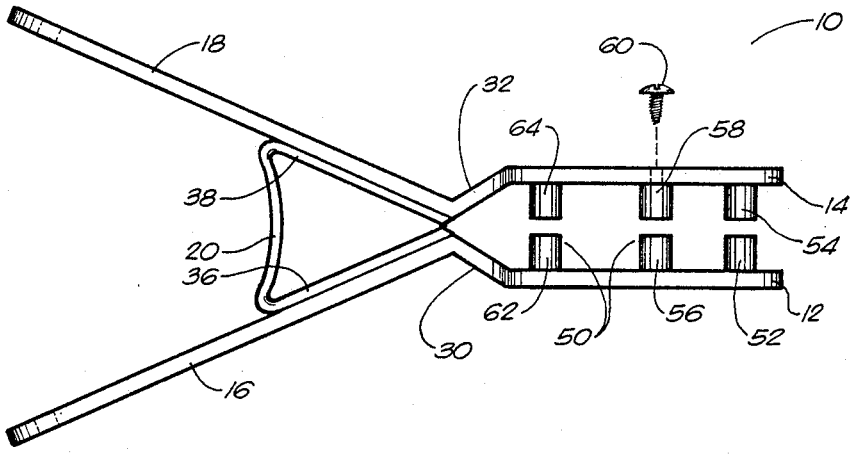
FIG. 2 is a top view of the protective device of the present invention showing, in particular, the arrangement of pins between the plate members.

FIG. 2 is a top view showing the internal configuration of protective device 10. In particular, FIG. 2 shows the configuration of a plurality of pins 50 positioned within the area between first plate 12 and second plate 14. This plurality of pins 50 is received and fastened to the horizontal and vertical channels of each of the plate members 12 and 14. A first pin 52 is fastened, by threaded means, to the inner surface 54 of first plate member 12. Similarly, a second pin 54 is positioned on the inner surface of second plate member 14 in general alignment, and near abutment, with the first pin 52. Pins 52 and 54 are positioned so as to engage the inner surface of one end of the trigger guard of a gun. Pins 52 and 54 serve to prevent movement of the protective device 10 relative to the position of the trigger of a gun or the trigger guard of a gun.

First plate member 12 includes a third pin 56 that is fastened to the vertical channel 24 of the first plate member 12. Similarly, a fourth pin 58 is attached to the inner surface of second plate member 14 by a screw 60 (illustrated in exploded view). The third pin 56 and the fourth pin 58 are positioned adjacent the rearward portion of the trigger of a gun. The placement of pins 56 and 58 prevents the trigger of a gun from being cocked when the protective device 10 is in position about the trigger guard of a gun.

Fifth pin 62 is fastened to the inner surface of first plate member 12. Sixth pin 62 is fastened to the inner surface of second plate member 14 in alignment with, and near abutment with, fifth pin 62. Pin 62 and 64 are positioned within horizontal slot 22 of plate member 12 and in the horizontal slot of the second plate member 14. Pins 62 and 64 are designed to be placed on the inner surface of the rearward portion of the trigger guard of a gun. The location of the pins, as placed between the plate members 12 and 14, is designed to prevent any movement of the protective device 10 relative to the trigger guard of a gun.

FIG. 2 further shows the arrangement of angled sections 30 and 32. Angled sections 30 and 32 maintain plate members 12 and 14 in proper parallel position during the normal, closed position of the protective device 10. It can be seen further that the spring 20 is positioned between arms 16 and 18 of the protective device 10. The spring 12 also includes the extending surfaces 36 and 38 along the inner walls of arms 16 and 18. Surfaces 36 and 38 terminate at the end of the arms 16 and 18 adjacent to the angled sections 30 and 32.

In operation, it is necessary to place the protective device 10 of the present invention about the trigger guard of a gun. This must be accomplished by one having the ability to exert a compressive force on arms 16 and 18 of greater than twenty-five pounds. The protective device 10 is positioned such that the pins 52 and 54 abut the inner surface of the forward portion of the trigger guard. The pins 62 and 64 will then abut the inner surface of the rearward portion of the trigger guard. When an emergency arises, the gun owner may pick up the gun having the protective device 10 installed. By simply squeezing the arms 16 and 18 with adequate compressive force, the plate members 12 and 14 will angularly separate so as to free the pins from about the trigger guard. Thusly, the protective device 10 may be removed from the trigger guard of a gun so as to make the gun available for use.

Figure 3:
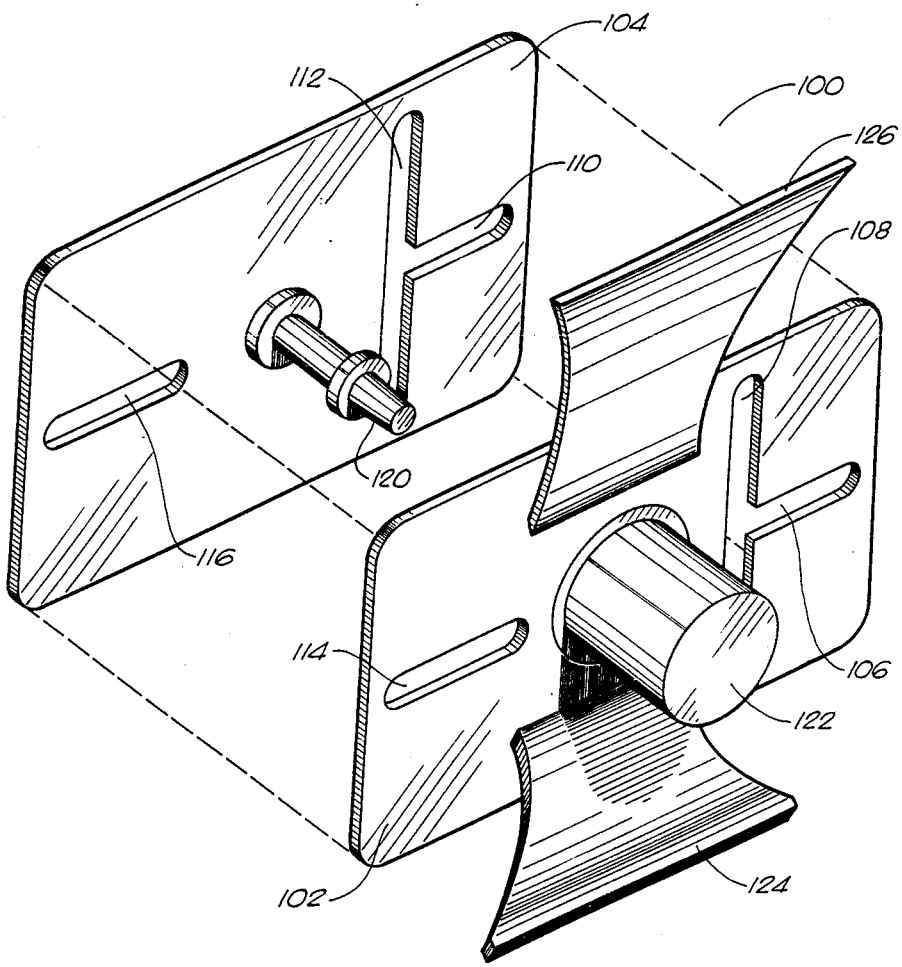
FIG. 3 is a perspective view of an alternative embodiment of the protective device of the present invention.

FIG. 3 illustrates an alternative embodiment of the present invention. In FIG. 3 protective device 100 is illustrated. This protective device includes a first plate 102 and a second plate 104. Plate 102 includes horizontal slot 106 and vertical slot 108. Similarly, plate 104 includes horizontal slot 110 and vertical slot 112. To accommodate the connection apparatus of this alternative embodiment, a separate horizontal slot 114 is included in plate 102. Also, a separate horizontal slot 116 is formed in second plate 104. The slots of each of the plates 102 and 104 are in position for alignment. Suitable pins may be attached, by threaded means, so as to be in the position such as that illustrated in FIG. 2. As with the preferred embodiment of the present invention, the alternative embodiment 100 has the slots in proper alignment so as to receive pins, by threaded means, between the inner surfaces of plates 102 and 104.

An extending member 120 is positioned on the inner surface of second plate 104. This member 120 is received by connector 122. Connector 122 is a plunger having a compression pressure of greater than twenty-five pounds. Member 120 will enter the inner surface of plunger 122 when the plates 102 and 104 are assembled together. The compression of plunger 122 serves to free member 120 therewithin. As such, the plates 102 and 104 will "fall apart" when plunger 122 is actuated. Grip members 124 and 126 extend outwardly from the outer wall of plate member 102. These grip members 124 and 126 are positioned on opposite sides of plunger 122. Grip members 124 and 126 provide suitable leverage so as to allow a proper adult user of the protective device 100 to be able to apply sufficient pressure to plunger 122.

As with the previous embodiment of the present invention, alternative embodiment 100 allows the proper adult user to seal the trigger of a gun within the trigger guard. The plates 102 and 104 have a size sufficient to completely cover the trigger guard so that children cannot get their fingers within the trigger guard. The plates 102 and 104 are retained in the proper position around the trigger guard until such time as the gun requires usage. By applying a compressive force to plunger 122, the protective device 100 is removed from about the trigger guard so as to free the gun for use.

The present invention, in its embodiments, offers significant advantages over the prior art. First, and foremost, the present invention provided adequate protection for the purpose of keeping children from gun usage. At the same time, the present invention allows the user of a gun the ability to use a gun in an emergency situation. The configuration of the protective device allows the user to quickly and easily remove the device from about the trigger guard of a gun. There is no need for keys, complex manual manipulations, levers, or other odd mechanisms that must be actuated so as to free the protective device from about the trigger. Additionally, the present invention can be manufactured and sold at a reasonable price. The ability to sell the protective device 10 of the present invention at a reasonable price makes the device very attractive to potential customers. The device is easy to understand and easy to install. Additionally, the present invention is adaptable to a wide variety of trigger guard sizes, shapes, and configurations. As such, the present invention offers a superior protective device to that of the prior art.

The foregoing disclosure and description of the invention is illustrative and explanatory thereof. Various changes in the details of the illustrated apparatus may be made within the scope of the appended claims without departing from the true spirit of the invention. The present invention should only be limited by the following claims and their legal alternatives.

I claim:

1. A protective device for a trigger guard of a gun comprising:

a first plate member;

a second plate member;

a plurality of pins affixed to one of said first and second plate members, said plurality of pins extending between said first and second plate members; and compression means connected to said first and second plate members, said compression means for causing said first and second plate members to separate from each other upon receiving a desired compression force.

2. The protective device of claim 1, said first and second plate members movable between a position in parallel relation to each other to a position angularly separated.

3. The protective device of claim 1, said first plate member having a horizontal channel extending therethrough, said horizontal channel for receiving at least one of said plurality of pins.

4. The protective device of claim 3, said first plate member having a vertical channel extending therethrough, said vertical channel intersecting said horizontal channel, said vertical channel for receiving at least one of said plurality of pins.

5. The protective device of claim 3, said second plate member having a horizontal channel extending therethrough, said horizontal channel of said second plate member for receiving at least one of said plurality of pins, said horizontal channel of said second plate member aligned with said horizontal channel of said first plate member.

6. The protective device of claim 5, said second plate member having a vertical channel extending therethrough, said vertical channel intersecting said horizontal channel of said second plate member, said vertical channel of said second plate member for receiving at least one of said plurality of pins.

7. The protective device of claim 1, each of said first plate member and said second plate member having a plurality of pins affixed thereto, said pins of said first plate member in alignment with said pins of said second plate member.

8. The protective device of claim 1, each of said first plate member and said second plate member having a surface area greater than the area of said trigger guard of said gun.

9. The protective device of claim 1, each of said plurality of pins being threadedly connected to one of said first and second plate members.

10. The protective device of claim 1, said compression means comprising:

a first arm connected to said first plate member;

a second arm connected to said second plate member; and spring means positioned between said first arm and said second arm so as to resist movement of said first arm and said second arm relative to each other.

11. The protective device of claim 10, said first arm and said second arm being angularly separated, each of said first arm and said second arm having one end in close proximity to the end of the other, said spring means being a tensioned steel strut of arcuate form extending between said first and second arms.

12. The protective device of claim 10, said spring means resistive of the application of less than twenty-five pounds of compression force.

13. The protective device of claim 11, said first plate member having an angled section extending to said one end of said first arm, said second plate member having an angled section extending to said one end of said second arm.

14. A protective device for a trigger guard of a gun comprising:

a first plate member;

a second plate member;

a first arm connected to said first plate member;

a second arm connected to said second plate member; and compression means arranged between said first arm and said second arm for resisting twenty-five pounds or less of compressive force exerted on said first arm and said second arm, said first plate member and said second plate member movable upon the relative movement between said first arm and said second arm.

15. The protective device of claim 14, each of said first and second plate members having a surface area greter than the area of said trigger guard.

16. The protective device of claim 14, further comprising:

a pin affixed to one of said first and second plate members and extending between said first and second plate members, said pin for fixing said plate member in a desired position surrounding said trigger guard.

17. The protective device of claim 16, further comprising:

a plurality of pins affixed to one of said first plate member and said second plate member, said plurality of pins in near abutment between said first and second plate members.

18. The protective device of claim 17, each of said first and second plate members having a channel extending therethrough for selectively positioning said plurality of pins relative to said trigger guard of said gun.

19. The protective device of claim 14, said first and second plate members angularly separating from each other upon the application of compressive force to said first and second arms.

20. The protective device of claim 14, said compression means comprising:

a tensioned steel spring having one end fastened to the said first arm and the other end fastened to said second arm.

* * * * *